US007754291B2

(12) United States Patent
Bree et al.

(10) Patent No.: US 7,754,291 B2
(45) Date of Patent: Jul. 13, 2010

(54) MINIATURE EMBLEMS AND METHOD OF MAKING SAME

(75) Inventors: Charles E. Bree, Delaware, OH (US); Urban R. Nannig, North Kingstown, RI (US)

(73) Assignee: Auld Technologies LLC, Columbus, OH (US)

( * ) Notice: Subject to any disclaimer, the term of this patent is extended or adjusted under 35 U.S.C. 154(b) by 554 days.

(21) Appl. No.: 11/091,687

(22) Filed: Mar. 28, 2005

(65) Prior Publication Data

US 2005/0233782 A1 Oct. 20, 2005

Related U.S. Application Data

(60) Provisional application No. 60/557,016, filed on Mar. 26, 2004.

(51) Int. Cl.
*B05D 1/26* (2006.01)

(52) U.S. Cl. ..... 427/427.3; 427/424; 427/427.4

(58) Field of Classification Search ..... None
See application file for complete search history.

(56) References Cited

U.S. PATENT DOCUMENTS

| | | | | | |
|---|---|---|---|---|---|
| 4,100,010 | A | | 7/1978 | Waugh | |
| 4,139,654 | A | | 2/1979 | Reed | |
| 4,225,638 | A | * | 9/1980 | Waugh | 427/331 |
| 4,292,827 | A | * | 10/1981 | Waugh | 72/46 |
| 4,356,617 | A | * | 11/1982 | Coscia | 29/527.4 |
| 4,481,160 | A | | 11/1984 | Bree | |
| 4,556,588 | A | | 12/1985 | Rockwood | |
| 5,458,931 | A | | 10/1995 | Mankes | |
| 6,410,080 | B1 | | 6/2002 | Ito | |
| 6,445,939 | B1 | | 9/2002 | Swanson et al. | |
| 7,033,761 | B2 | * | 4/2006 | Shafer | 435/6 |
| 2002/0142111 | A1 | * | 10/2002 | Auld et al. | 428/13 |

FOREIGN PATENT DOCUMENTS

JP 05-077258 A * 3/1993

* cited by examiner

*Primary Examiner*—William Phillip Fletcher, III
(74) *Attorney, Agent, or Firm*—Dinsmore & Shohl LLP

(57) ABSTRACT

A method for making miniature emblems. The method includes providing an array of shaped miniature substrates, each shaped miniature substrate having an upper surface and a bottom surface; holding the array of shaped miniature substrates flat and horizontal; providing a plurality of orifices, the plurality of orifices and the array of shaped miniature substrates being capable of moving relative to each another in an X direction, a Y direction, and a Z direction; positioning the plurality of orifices over the array of shaped miniature substrates; positioning the plurality of orifices in close proximity with the array of shaped miniature substrates; depositing a volume of viscous fluent plastic of less than about 0.04 ml from the plurality of orifices onto the upper surface of each of the shaped miniature substrates, the viscous fluent plastic forming a positive meniscus on the upper surface; and curing the plastic while maintaining the array of shaped miniature substrates flat and horizontal, whereby the cured plastic forms a dome over each shaped miniature substrate.

20 Claims, 1 Drawing Sheet

MINIATURE EMBLEMS AND METHOD OF MAKING SAME

This application claims priority to provisional application Ser. No. 60/557,016, filed Mar. 26, 2004, entitled "Miniature Emblems and Method of Making Same", which is incorporated herein by reference.

BACKGROUND OF THE INVENTION

The present invention relates to miniature emblems and to methods for making them. More particularly, the invention relates to a method in which one drop or less of a fluent plastic composition is deposited onto a shaped, miniature substrate and then cured, and to such miniature emblems as produced.

Decorative emblems are used in a number of industries for displaying the trade name, trademark, or other indicia of a manufacture, as well as in novelty items such as key rings, belt buckles, and the like where their role is primarily ornamentation. Years ago, decorative emblems were formed from vitreous enamel which gave the emblem a glass-like appearance and protected the emblem against weathering. More recently, such emblems have been made using plastic in place of enamel.

Waugh, U.S. Pat. No. 4,100,010, the disclosure of which is hereby incorporated by reference, discloses a plastic-capped decorative emblem which is formed by casting a polyurethane composition onto the indicia-bearing surface of a decorative foil disc. By holding the disc in a flat, horizontal position and using the appropriate casting techniques, the polyurethane flows to the edge of the disc, stops and builds a positive meniscus, which when cured provides an impact and weather resistant glass-like lens cap. Rockwood, U.S. Pat. No. 4,556,588, the disclosure of which is also hereby incorporated by reference, discloses an emblem, having a plastic lens cap which is sufficiently flexible to conform to the curvature of a surface.

Decorative emblems prepared using the teachings of the aforementioned patents are typically coated on the back side with a pressure sensitive adhesive and either applied directly to the surface they are designed to adorn or inserted into a base member or bezel and then attached to the surface. In the former case, if the plastic cap is formed from a material which is flexible when cured, the shape can conform to curved non-planar surfaces.

Flip-up cell phones can be damaged when they are closed. Preventing such damage is necessary to increase the durability of the cell phones. Flexible, cushioning, plastic "bumpers" can be used to prevent such damage. While the flexible plastic emblems discussed above would serve that purpose, the flexible emblems of the prior art are too large to serve this purpose.

Therefore, there is a need for a method of making miniature emblems.

SUMMARY OF THE INVENTION

The present invention meets this need by providing a method for making miniature emblems. The method includes providing an array of shaped miniature substrates, each shaped miniature substrate having an upper surface and a bottom surface; holding the array of shaped miniature substrates flat and horizontal; providing a plurality of orifices, the plurality of orifices capable of moving in an X direction, a Y direction, and a Z direction; moving the plurality of orifices in the X and Y directions to position the plurality of orifices over a portion of the array of shaped miniature substrates; lowering the plurality of orifices in the Z direction into close proximity with the array of shaped miniature substrates; depositing a single drop or less of viscous fluent plastic from the plurality of orifices onto the upper surface of each of the shaped miniature substrates, the single drop or less of viscous fluent plastic forming a positive meniscus on the upper surface; and curing the plastic while maintaining the array of shaped miniature substrates flat and horizontal, whereby the single drop or less of cured plastic forms a dome over each shaped miniature substrate.

Another aspect of the invention is the miniature emblems produced by the process. The miniature emblems include a shaped miniature substrate having an upper surface, and a plastic dome cap overlying the upper surface. Another aspect of the invention is cell phones which incorporate the miniature emblems. The miniature emblems provide a bumper between the flip-up portion and the bottom portion of the cell phone.

DETAILED DESCRIPTION OF THE INVENTION

The miniature emblem of the present invention includes a shaped miniature substrate having an upper surface, and a translucent plastic lens cap overlying the upper surface, the dome formed from a single drop or less of plastic. Preferable, the upper surface is indicia-bearing, i.e., being colored, or having indicia, graphics, or other decorations found thereon.

Figure 1:
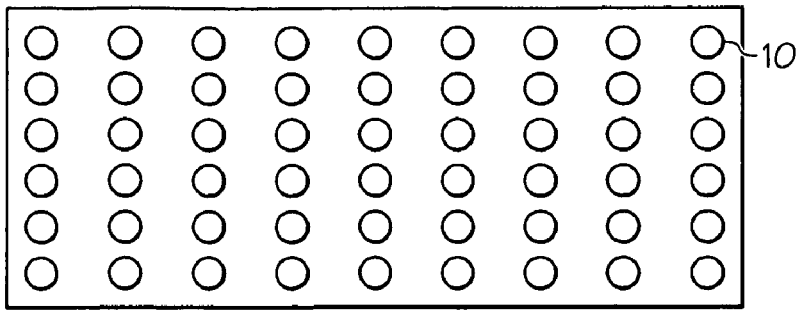
FIG. 1 shows a layout of an array of emblem substrates.

It has been found that a flexible miniature emblem can serve protective purposes such as serving as "bumpers" on a flip-up cell phone to prevent damage to the cell phone when the flip-top is closed. However, in order to serve that purpose, a miniaturized emblem having a shaped, small substrate on the order of hundredths of a square inch (generally in the range of about 0.01 to about 0.09 $in^2$, typically in the range of about 0.03 to about 0.05 $in^2$) is needed. That requires casting a very small amount of fluent plastic, even as little as a single drop or less onto the shaped, small substrate, i.e., the volume is generally less than about 0.04 ml, typically about 0.01 ml to about 0.035 ml. The height of the drop is generally less than about 0.05 in. For example, as shown on FIG. 1, which is a layout of an array of emblem substrates 10 to have a plastic dome cast on each and be cured for use as cell phone bumpers, the area of each substrate is 0.021 inches. Each of the twenty-four dispensing nozzles has an OD of 0.065 inches and an I.D. of 0.047 inches.

While it is known in Coscia U.S. Pat. No. 4,356,617, the disclosure of which is hereby incorporated by reference, to use a plurality of dispenser orifices to form one emblem having a relatively thin lens cap, the present method uses multiple dispensing orifices each one of which deposits a single drop or less of fluent plastic material onto a single shaped, small substrate in an array of substrates aligned beneath the multiple orifice casting head. The casting head is then moved in an X-Y manner to cast another array of substrates.

However, in order to deposit a single drop or a portion of a drop, a "Z" mode was added to the X-Y system (using for example an air cylinder to move the casting head up and down) whereby the multiple orifice casting head is lowered into close proximity to the array of substrates and each nozzle orifice is sufficiently close to each shaped, small substrate so that when a drop of fluent plastic starts to form it just barely touches the shaped, small substrate and is wicked out of the orifice and deposited on the substrate as the casting head raises, leaving behind no more than a single drop deposited.

Figure 2:
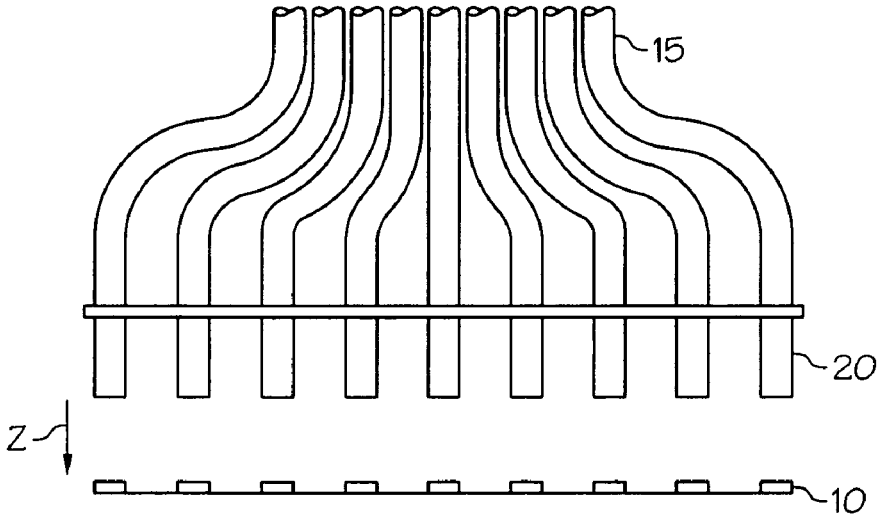
FIG. 2 is a diagram showing the plurality of orifices in the raised position above the array of emblem substrates.
Figure 3:
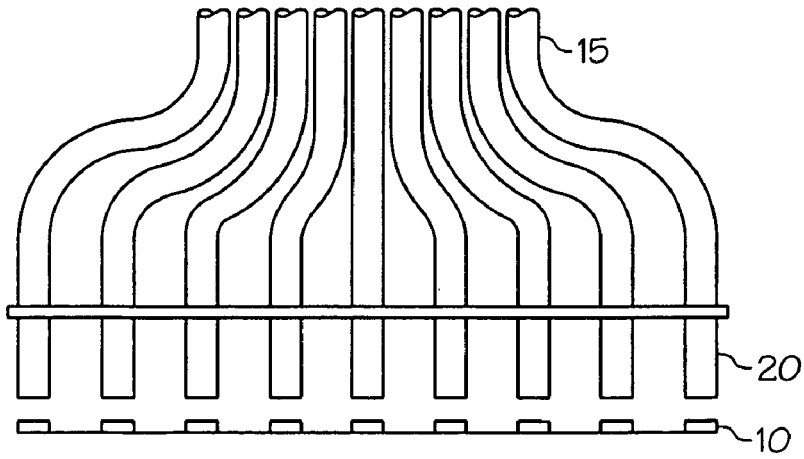
FIG. 3 is a diagram showing the plurality of orifices in the lowered position ready to deposit the single drop or less of plastic onto the array of emblem substrates.

FIG. 2 shows the multiple orifice casting head 15 in the raised position. The casting head 15 has a plurality of individual orifices 20. The casting head 15 is moved in the X-Y directions to position it over the shaped, small substrates 10. The casting head 15 is then lowered in the Z direction so that the individual orifices 20 are in close proximity to the shaped, small substrates 10, as shown in FIG. 3. When a drop of plastic starts to form it just barely touches the shaped, small substrate 10 and is wicked out the orifice 20. No more than a single drop is deposited on each shaped, small substrate 10 by the individual orifice 20 as the casting head 15 is raised to the position of FIG. 2. The casting head 15 is then moved in the X-Y directions to another position over the shaped, small substrates, and the process is repeated. The substrates are preferably stationary, although they need not be stationary. For example, the substrates could be moved on a conveyer belt, as described in U.S. Pat. No. 4,100,010. A conveyer belt can be located under the casting head. The conveyor carries the substrates. When a substrate comes under the casting head, the belt stops, and the plastic can be deposited as described above. The conveyer belt then moves the substrates forward.

The suck-back system of Waugh, U.S. Pat. No. 4,225,638, the disclosure of which is hereby incorporated by reference, can be used to assure that no more than a single drop of fluent plastic is released from each nozzle orifice. Likewise, frequent solvent flushing can be used to assure that there is no extra plastic build-up in the nozzle orifices. In a typical arrangement, the casting head can have 24 nozzle orifices, each having an ID of 0.047 inches. The ID can be adjusted depending on the size of the substrate and the volume of fluent plastic to be cast, in order to maintain the single drop (or less) formation approach of the present invention.

The result is a miniaturized emblem having a flexible dome of a sufficient height to serve as a bumper when one, two, or more are applied at a point of contact between the flip-top portion and bottom portion of a flip-up cell phone. The miniature emblem can be placed on the inner surface of either the flip-top portion or the bottom portion near the end of the cell phone opposite the hinge. The miniature emblem provides a bumper which prevents the two parts from contacting each other and causing damage to the cell phone.

The substrate can be formed by either of the processes disclosed in U.S. Pat. No. 4,100,010 to Waugh or U.S. Pat. No. 4,139,654 to Reed, the disclosure of which is hereby incorporated by reference. The foil member is preferably a plastic foil such as Mylar, but it may also be a metal foil such as aluminum or a metalized plastic foil or a paper backed plastic foil.

Optionally, the upper surface of the foil may be colored or have indicia, graphics, or other decorations thereon. For best results, the foil should be free of moisture, grease, dust and other foreign matter prior to being decorated. If desired, the foil member may be primed prior to printing or painting the surface with the color, indicia, graphic, or other decoration in order to improve the adherence of the foil for the paint and/or printing and to prevent peeling.

The coloring or indicia, graphic, or other decoration may be formed on the foil member using a conventional printing technique such as silk screen printing, roto-gravure, etc.

Shapes according to the trademark, emblem, medallion based on the intended use or location of use are cut from the foil. Any shape can be used. Typically, the foil is first preprinted or pre-colored with the desired design or color and cut in registry therewith; although, the shapes may be cut before being decorated in some instances. The substrates can have a pressure sensitive adhesive and a release liner on the undecorated, non-capped side as in U.S. Pat. No. 4,100,010 or U.S. Pat. No. 4,139,654, if desired. The mixing and casting of the fluent plastic can be accomplished using the system in U.S. Pat. No. 4,100,010 or U.S. Pat. No. 4,139,654.

As explained in more detail in U.S. Pat. No. 4,100,010, the wetting characteristics of the plastic coating composition should be such that when a deposit of the plastic composition is placed on the foil shape it flows to the edge of the shape and builds into a positive meniscus. This plastic deposit is subsequently cured. The plastic may be cured in a number of ways, such as by heating, irradiation, or in some cases, an "ambient cure" can be effected by the exothermic heat of the curing reaction. In the case of a polyurethane composition, the latter curing is obtained by providing sufficient catalyst to trigger the exothermic reaction. The cured plastic forms a lens cap which gives a lens effect to the graphic surface beneath, if any. Alternatively, a plain, undecorated substrate may be used, and the plastic coating composition tinted to provide a colored miniature emblem.

The plastic cap is formed from a material which preferably is also weather and impact resistant. One suitable plastic is an impact-resistant polyurethane. To conform to non-planar surfaces, such as the curved surface of a cell phone, the plastic lens cap must be flexible. Polyurethanes having a Shore D hardness of 45 to 65, preferably 45 to 55 are sufficiently flexible for this purpose. Several of these polyurethanes are well known and are described in the aforementioned Waugh patent. It will be obvious to those skilled in the art that various changes may be made without departing from the scope of the invention which is not to be considered limited to what is described in the specification.

What is claimed is:

1. A method for making miniature emblems, comprising:

providing an array of shaped miniature substrates, each shaped miniature substrate having an upper surface and a bottom surface;

holding the array of shaped miniature substrates flat and horizontal;

providing a plurality of orifices, the plurality of orifices and the array of shaped miniature substrates being capable of moving relative to each another in an X direction, a Y direction, and a Z direction;

positioning the plurality of orifices over the array of shaped miniature substrates by relative movement of the plurality of orifices and the array of shaped miniature substrates in the X direction and the Y direction;

positioning the plurality of orifices in close proximity with the array of shaped miniature substrates by relative movement of the plurality of orifices and the array of shaped miniature substrates in the Z direction after positioning the plurality of orifices by relative movement in the X and Y direction;

depositing a volume of viscous fluent plastic of less than about 0.04 ml from the plurality of orifices onto the upper surface of each of the shaped miniature substrates, the viscous fluent plastic forming a positive meniscus on the upper surface while the plurality of orifices is in close proximity with the array of shaped miniature substrates, each orifice depositing the volume of viscous fluent plastic on a different single one of the shaped miniature substrates; and curing the plastic while maintaining the array of shaped miniature substrates flat and horizontal, whereby the cured plastic forms a dome over each shaped miniature substrate.

2. The method of claim 1 wherein depositing the volume of viscous fluent plastic comprises forming a drop of uncured viscous fluent plastic in each orifice, touching the drop of viscous fluent plastic while it is in the orifice to the upper surface, and wicking the drop of viscous fluent plastic out of each orifice.

3. The method of claim 1 wherein an area of each shaped miniature substrate is in a range from about 0.01 to about 0.09 $in^2$.

4. The method of claim 1 wherein the plastic is a polyurethane.

5. The method of claim 1 further comprising providing a release liner on the bottom surface.

6. The method of claim 1 further comprising creating a negative pressure in the plurality of orifices sufficient to draw back any remaining uncured viscous fluent plastic adhering to the plurality of orifices but insufficient to cause air to be sucked back into the plurality of orifices, whereby drippage of the uncured viscous fluent plastic is prevented.

7. The method of claim 1 further comprising flushing the plurality of orifices with solvent to prevent build-up of plastic in the plurality of orifices.

8. The method of claim 1 wherein the substrate comprises a foil selected from plastic foils, metal foils, metallized plastic foils, or paper-backed plastic foils.

9. The method of claim 1 wherein the miniature emblem is colored or has coloring, indicia, graphics, or decorations formed on the upper surface of the substrate.

10. The method of claim 1 wherein the plastic is tinted.

11. The method of claim 1 further comprising raising the plurality of orifices in the Z-direction as the volume is deposited.

12. A method for making miniature emblems, comprising:

providing an array of shaped miniature substrates, each shaped miniature substrate having an upper surface and a bottom surface, an area of each shaped miniature substrate being in a range from about 0.01 to about 0.09 $in^2$;

holding the array of shaped miniature substrates flat and horizontal;

providing a plurality of orifices, the plurality of orifices and the array of shaped miniature substrates being capable of moving relative to each another in an X direction, a Y direction, and a Z direction;

positioning the plurality of orifices over the array of shaped miniature substrates by relative movement of the plurality of orifices and the array of shaped miniature substrates in the X direction and the Y direction;

positioning the plurality of orifices in close proximity with the array of shaped miniature substrates by relative movement of the plurality of orifices and the array of shaped miniature substrates in the Z direction after positioning the plurality of orifices by relative movement in the X and Y direction;

forming a drop of uncured viscous fluent plastic in each orifice, touching the drop of viscous fluent plastic while it is in the orifice to the upper surface, and wicking the drop of viscous fluent plastic out of each orifice so that the drop of viscous fluent plastic is deposited onto the upper surface of each shaped miniature substrate, the drop of viscous fluent plastic forming a positive meniscus on the upper surface, each orifice depositing the drop of viscous fluent plastic on a different single one of the shaped miniature substrates;

raising the plurality of orifices in the Z-direction as the drop is deposited; and curing the plastic while maintaining the array of shaped miniature substrates flat and horizontal, whereby the drop of cured plastic forms a lens cap over each shaped miniature substrate which gives a lens effect to the upper surface.

13. The method of claim 12 wherein a volume of the drop is less than about 0.04 ml.

14. A method for making miniature emblems, comprising:

providing an array of shaped miniature substrates, each shaped miniature substrate having an upper surface and a bottom surface;

holding the array of shaped miniature substrates flat and horizontal;

providing a plurality of orifices;

moving the plurality of orifices over the array of shaped miniature substrates by relative movement of the plurality of orifices and the array of shaped miniature substrates in the X direction and the Y direction;

moving the plurality of orifices in close proximity to the array of shaped miniature substrates by relative movement of the plurality of orifices and the array of shaped miniature substrates in the Z direction after moving the plurality of orifices over the array of shaped miniature substrates;

depositing a volume of viscous fluent plastic of less than about 0.04 ml from each of the plurality of orifices onto the upper surface of each of the shaped miniature substrates while the plurality of orifices is in close proximity to the array of shaped miniature substrates, the viscous fluent plastic forming a positive meniscus on the upper surface, each orifice depositing the volume of viscous fluent plastic on a different single one of the shaped miniature substrates;

moving the plurality of orifices away from the array of shaped miniature substrates by relative movement of the plurality of orifices and the array of shaped miniature substrates in the Z direction after depositing the volume of viscous fluent plastic; and curing the plastic while maintaining the array of shaped miniature substrates flat and horizontal, whereby the cured plastic forms a dome over each shaped miniature substrate.

15. The method of claim 14 wherein depositing the volume of viscous fluent plastic comprises forming a drop of uncured viscous fluent plastic in each orifice, touching the drop of viscous fluent plastic to the upper surface, and wicking the drop of viscous fluent plastic out of each orifice.

16. The method of claim 14 wherein an area of each shaped miniature substrate is in a range from about 0.01 to about 0.09 $in^2$.

17. The method of claim 14 wherein the plastic is a polyurethane.

18. The method of claim 14 further comprising providing a release liner on the bottom surface.

19. The method of claim 14 further comprising creating a negative pressure in the plurality of orifices sufficient to draw back any remaining uncured viscous fluent plastic adhering to the plurality of orifices but insufficient to cause air to be sucked back into the plurality of orifices, whereby drippage of the uncured viscous fluent plastic is prevented.

20. The method of claim 14 wherein moving the plurality of orifices away from the array of shaped miniature substrates by relative movement of the plurality of orifices and the array of shaped miniature substrates in the Z direction after depositing the volume of viscous fluent plastic comprises raising the plurality of orifices in the Z-direction as the volume is deposited.

* * * * *